US007013522B2

(12) United States Patent
Kumagai

(10) Patent No.: US 7,013,522 B2
(45) Date of Patent: Mar. 21, 2006

(54) TOOTHBRUSH ASSEMBLY WITH SOUND GENERATING FUNCTION

(75) Inventor: Toshinori Kumagai, Tokyo (JP)

(73) Assignee: Ablecorporation, Ltd., Tokyo (JP)

( * ) Notice: Subject to any disclaimer, the term of this patent is extended or adjusted under 35 U.S.C. 154(b) by 551 days.

(21) Appl. No.: 10/286,861

(22) Filed: Nov. 4, 2002

(65) Prior Publication Data

US 2004/0000017 A1 Jan. 1, 2004

(30) Foreign Application Priority Data

Jul. 1, 2002 (JP) ..... 2002-004010
Aug. 9, 2002 (JP) ..... 2002-232896
Sep. 13, 2002 (JP) ..... 2002-268238

(51) Int. Cl.
*A46B 15/00* (2006.01)

(52) U.S. Cl. ..... 15/105; 15/167.1; 434/263

(58) Field of Classification Search ..... 15/105, 15/167.1; 434/263
See application file for complete search history.

(56) References Cited

U.S. PATENT DOCUMENTS 4,341,230 A 7/1982 Siahou
6,397,424 B1 * 6/2002 Leung ..... 15/105

FOREIGN PATENT DOCUMENTS

CA 2232528 * 9/1999
JP 7-236519 * 9/1995

* cited by examiner

*Primary Examiner*—Mark Spisich
(74) *Attorney, Agent, or Firm*—Venable LLP; Michael A. Sartori

(57) ABSTRACT

A toothbrush assembly with a sound generating function for providing excitement and entertainment to a user and for encouraging a young child to brush his or her teeth is provided. The toothbrush assembly has a contact-type switch and a sound generator. The contact-type switch has a swingable contact and generates a pulse when a power switch of the assembly is instantaneously closed for every swing of the swingable contact according to the tooth-brushing movement of a user. The sound generator has a counter for counting pulses from the contact-type switch and a sound recording and play back unit for generating a voice message or musical tone when the sum of the pulses counted by the counter reaches a predetermined value. The sound recording and play back unit of the sound generator outputs different voice messages or musical tones according to different predetermined values reached by the sum of the pulses counted by the counter.

3 Claims, 5 Drawing Sheets

TOOTHBRUSH ASSEMBLY WITH SOUND GENERATING FUNCTION

BACKGROUND OF THE INVENTION

1. Field of the Invention

The present invention relates to toothbrush assemblies with sound generating functions, and more particularly, the present invention relates to a toothbrush assembly with a sound generating function for encouraging a young child to brush his or her teeth or for providing excitement to any user, in a wide age range from a child to an adult, with a voice message, a musical tone, or the like generated by the toothbrush assembly in accordance with the tooth-brushing movement of the user.

2. Description of the Related Art

Conventional toothbrush assemblies aimed at young children have various character pictures or figures on the holders thereof so as to keep the young children interested with the pictures or figures while brushing their teeth. Also, known various toothbrush assemblies aimed at users from children to adults have improved their usability. Furthermore, based on the recent miniaturization of electronic components, each of the known toothbrush assemblies has an electronic circuit incorporated therein for playing back music or the like in association with the tooth-brushing movement of a user. An example toothbrush assembly disclosed in U.S. Pat. No. 4,341,230 generates a sound when a user operates an additional switch disposed on the holder of thereof or plays back music by turning on the switch when brushing begins.

However, the conventional toothbrush assemblies without sound generating functions do not encourage young children to brush their teeth at all, and also the use of only character pictures or figures on the holders is neither entertaining nor interesting and, unfortunately, they sometimes become uninteresting and boring.

Also, in the foregoing toothbrush assembly having the switch which operates in association with the above-described tooth-brushing movement, the moving direction of the switch is limited to one direction, and accordingly, the toothbrush assembly is not responsive to the complicated tooth-brushing movement of a user.

SUMMARY OF THE INVENTION

Accordingly, it is a major object of the present invention to provide a toothbrush assembly with a sound generating function which operates in association with the tooth-brushing movement of a user so as to be more entertaining or interesting than the conventional toothbrush assemblies and also to encourage a young child or a similar user to brush his or her teeth.

It is another object of the present invention to provide a toothbrush assembly having a switch responsive to the complicated tooth-brushing movement of a user and also having a function for generating a sound or the like in accordance with an operation of the switch.

It is yet another object of the present invention to provide a toothbrush assembly with a sound generating function in which a tooth-brushing portion, a battery used for a sound generator, and the like are easily replaced with corresponding new ones.

In order to achieve the above objects, a toothbrush assembly with a sound generating function according to the first aspect of the present invention includes a swing-type switch for generating pulses in accordance with the tooth-brushing movement of a user; a counter for counting pulses sent from the swing-type switch; and a sound generator for generating a voice message or a musical tone, or for stopping the generation of a voice message or a musical tone, when the sum of the pulses counted by the counter reaches a predetermined value.

In the toothbrush assembly according to the first aspect, the sound generator generates different voice messages in accordance with the sum of the pulses counted by the counter when the sum reaches different predetermined values.

In the toothbrush assembly according to the first aspect, the swing-type switch includes a stationary ring contact fixed in the front part of the toothbrush assembly; a wire-spring swingable contact swingably inserted into the ring of the stationary ring contact; and a weight firmly fixed at the front of the swingable contact, and wherein the swing-type contact generates a pulse when the wire-spring swingable contact swings due to the inertia of the weight in accordance with the tooth-brushing movement and thus contacts the stationary ring contact.

The toothbrush assembly according to the first aspect further includes a power switch, wherein the sound generator includes a power supply controller for making the counter operative when the power switch is closed upon the first contact of the swingable contact to the stationary contact and for making the counter inoperative when the counter does not receive a pulse for a predetermined time period.

In order to achieve the above objects, a toothbrush assembly with a sound generating function according to the second aspect of the present invention includes a sound generator; a holding portion housing the sound generator; an elastic member; a tooth-brushing portion comprising a handle which is supported by the elastic member and the end of which is inserted into the holding portion so as to swing in accordance with the brushing movement of a user; and a contact-type switch comprising a ring contact; and a rod-like contact, both being disposed between the end of the handle and the inner wall of the holding portion, wherein the sound generator controls the generation of different voice messages or musical tones in accordance with the movement of the contact-type switch.

In the toothbrush assembly according to the second aspect, the sound generator includes a power supply controller; a counter for counting pulses sent from the contact-type switch; a sound recording and playback unit, and a loudspeaker, and wherein the sound recording and playback unit starts or stops playing back a voice message or a musical tone through the loudspeaker when the sum of the pulses counted by the counter reaches a predetermined value.

In the toothbrush assembly according to the second aspect, the elastic member for supporting the handle of the toothbrush assembly is a waterproof packing member.

In the toothbrush assembly according to the second aspect, the contact-type switch includes the rod-like contact which is swingable and which protrudes from the end of the handle of the toothbrush assembly; and the ring contact which is stationary, and the swingable contact is inserted into the center of the ring contact, and wherein the swingable contact contacts the inner part of the ring of the stationary ring contact when the handle of the toothbrush assembly swings.

The toothbrush assembly according to the second aspect further includes a power switch, wherein the sound generator includes a power supply controller for making the counter operative when the power switch is closed upon the first contact of the swingable contact to the stationary contact and for making the counter inoperative when the counter does not receive a pulse for a predetermined time period.

In order to achieve the above objects, a toothbrush assembly with a sound generating function according to the third aspect of the present invention includes a sound generator; a holding portion housing the sound generator; an elastic member; a tooth-brushing portion; a tooth-brushing-portion support which supports the end of the tooth-brushing portion, which is supported by the holding portion via the elastic member, and the end of which swings in the holding portion in accordance with the tooth-brushing movement of a user; and a contact-type switch comprising a stationary ring contact disposed in the holding portion; and a swingable contact disposed at the end of the tooth-brushing-portion support, wherein the sound generator controls the generation of different voice messages or musical tones in accordance with the movement of the contact-type switch.

In the toothbrush assembly according to the third aspect, the holding portion includes contacts and is dividable into two parts, one housing the contact-type switch, the other housing the sound generator, and wherein the contact-type switch and the sound generator are electrically connected via the contacts when the two parts are coupled with each other.

In the toothbrush assembly according to the third aspect, the tooth-brushing portion is fitted into the tooth-brushing-portion support or fitted into and supported by the same.

The toothbrush assembly according to the first aspect of the present invention has the sound generator for generating a voice message or a musical tone or for stopping the generation of a voice message or a musical tone when the sum of the pulses counted by the counter reaches a predetermined value, and thus can generate sounds until the user completes the predetermined amount of tooth-brushing.

The toothbrush assembly according to the first aspect may generate different voice messages in accordance with the degree of an amount of tooth-brushing.

Also, the toothbrush assembly according to the first aspect may generate a pulse when the wire-spring swingable contact swings due to the inertia of the weight in accordance with the tooth-brushing movement and thus contacts the stationary ring contact.

Furthermore, the toothbrush assembly according to the first aspect may shut off its power supply when the tooth-brushing movement is suspended for a predetermined time period.

The toothbrush assembly according to the second aspect of the present invention controls the generation of different voice messages or musical tones in accordance with the movement of the contact-type switch.

Also, in the toothbrush assembly according to the second aspect, the sound recording and play back unit starts or stops playing back a voice message or a musical tone through the loudspeaker when the sum of the pulses counted by the counter reaches a predetermined value.

In addition, in the toothbrush assembly according to the second aspect, since the elastic member for supporting the handle of the toothbrush assembly serves as a waterproof packing member, the inside of the holding portion can be hermetically sealed against water.

Furthermore, the toothbrush assembly according to the second aspect may have the swingable contact having a reduced direction dependency.

Moreover, the toothbrush assembly according to the second aspect may control the activation of the counter in accordance with the tooth-brushing movement.

The toothbrush assembly according to the third aspect of the present invention includes the contact-type switch and the sound generator controls the generation of different voice messages or musical tones in accordance with the movement of the contact-type switch.

Also, the toothbrush assembly according to the third aspect may be constructed such that the holding portion has contacts and is dividable in two parts, one housing the contact-type switch, and the other housing the sound generator, and such that the contact-type switch and the sound generator are electrically connected via the contacts when the two parts are coupled with each other.

Furthermore, the toothbrush assembly according to the third aspect may be constructed such that the tooth-brushing portion is fitted into the tooth-brushing-portion support or fitted into and supported by the same.

Since the toothbrush assembly according to the present invention has the above-described structure, in comparison to the conventional toothbrush assemblies, this toothbrush assembly with a sound generating function is more entertaining and interesting, and also provides more excitement to any user, in a wide age range from a child to an adult, in addition to encouraging a young child to brush his or her teeth.

That is, the toothbrush assembly according to the present invention has the contact-type switch which generates a pulse for every swing of the swingable contact in accordance with the tooth-brushing movement of a user, the counter or counting the pulses sent from the contact-type switch, and the sound generator for generating or stopping the generation of a voice message or a musical tone when the sum of the pulses counted by the counter reaches a predetermined value. With this configuration, encouraging messages, exciting musical tones, or the like can be easily sent and heard by a user who is brushing his or her teeth, thereby making the toothbrush assembly more entertaining and interesting than the conventional toothbrush assemblies.

Since the sound generator outputs different voice messages, musical tones or the like in accordance with different predetermined values reached by the sum of the pulses counted by the counter, the sound generator can easily send encouraging messages, exciting music, or the like in accordance with the number of tooth brushing movements.

The contact-type switch according to the third aspect detachably supports the end of the handle of the toothbrush assembly and has the swingable contact and the stationary ring contact. The swingable contact is attached to the tooth-brushing-portion support supported by the elastic packing member so as to be swingable relative to the hollow holding portion which houses the sound generator including the counter. Also, the swingable contact is inserted into the center of the ring of the stationary ring contact so as to contact the inner part of the ring when the tooth-brushing-portion support swings. The stationary ring contact and the swingable contact are both connected to the corresponding input terminals of the counter. Since the contact-type switch is constructed such that it generates a pulse and sends it to the counter when the swingable contact contacts the inner part of the ring of the stationary contact in accordance with the tooth-brushing movement, swings of the strongly shaken front part of the toothbrush assembly can be easily converted into pulses via the swingable contact attached to the tooth-brushing-portion support.

Since the tooth-brushing-portion support is swingably fitted into and supported by the holding portion via the elastic waterproof packing member, the swings of the strongly shaken front part of the toothbrush assembly can be reliably transferred to the tooth-brushing-portion support. Also, the inside of the hollow holding portion is always hermetically sealed against water by the backing member even when the tooth-brushing-portion support is swinging. In addition, the contact-type switch can easily convert the foregoing swings into precise pulses via the swingable contact attached to the tooth-brushing-portion support. Furthermore, batteries housed in the holding portion can be easily replaced with new ones since the holding portion is dividable.

Also, the toothbrush assembly may be constructed such that the counter is formed from a counter circuit which is activated by a pulse sent from, for example, the contact-type switch and counts clock pulses for a predetermined time period, for example, 10 seconds, and such that the sound recording and play back unit is maintained to operate when the counter is activated again within 10 seconds. When the counter does not receive a pulse from the contact-type switch for 10 seconds, the toothbrush assembly stops outputting a sound and shuts off its power supply. In any case, sounds are generated in association with the movement of the swing-type or contact-type switch.

DESCRIPTION OF THE PREFERRED EMBODIMENTS

Toothbrush assemblies with sound generating functions according to preferred embodiments of the present invention will be described with reference to the accompanying drawings.

Figure 1:
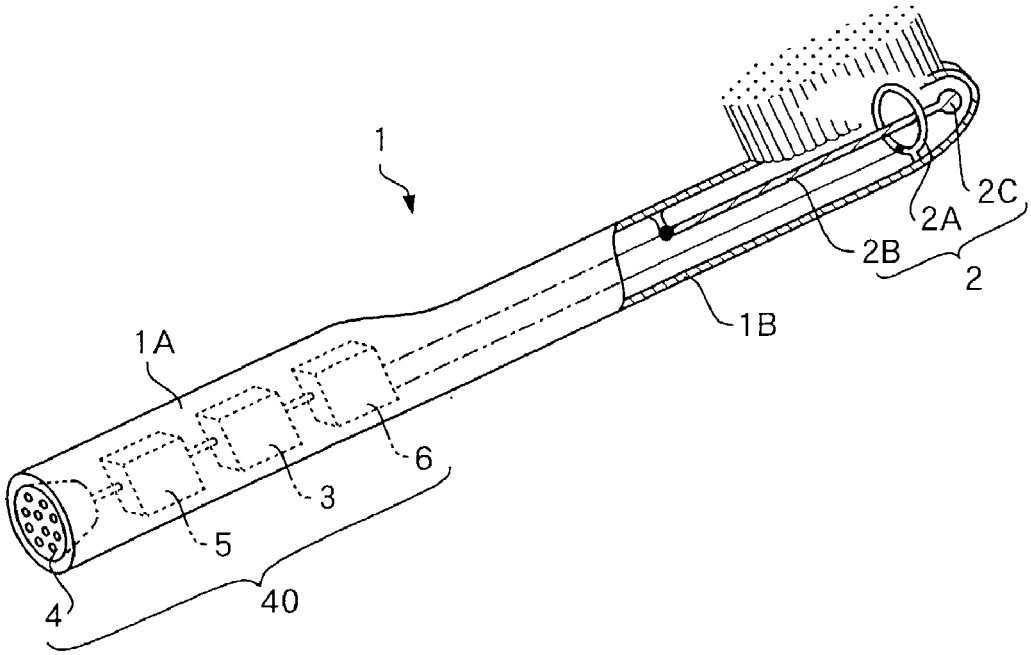
FIG. 1 is a schematic perspective view of a toothbrush assembly having a sound generating function and a swing-type switch according to a first embodiment of the present invention.
Figure 2:
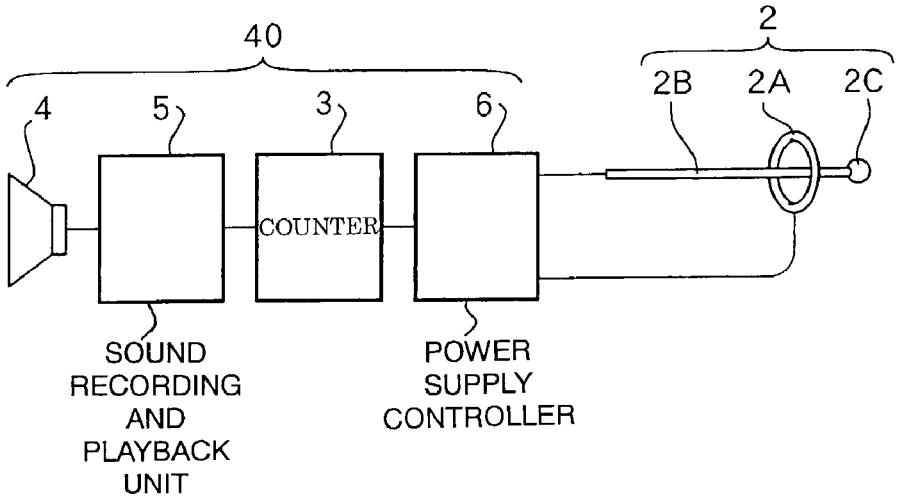
FIG. 2 illustrates a circuit configuration of the toothbrush assembly according to the first embodiment.

Referring first to FIGS. 1 and 2, a toothbrush assembly having a sound generating function and a swing-type switch according to a first embodiment of the present invention will be described. A toothbrush assembly 1 according to the first embodiment has a holding portion 1A and a tooth-brushing portion 1B housing a sound generator 40 and a swing-type switch 2, respectively, in addition to a power switch. The swing-type switch 2 has a swingable contact 2B and generates a pulse when the power switch is instantaneously closed for every swing of the swingable contact 2B in accordance with the tooth-brushing movement of a user. The sound generator 40 includes a counter 3, using, e.g., a T-type flip-flop binary counting circuit, for counting pulses sent from the swing-type switch 2, a sound recording and playback unit 5 for generating a voice message when the sum of the pulses counted by the counter 3 reaches a predetermined value, and a loudspeaker 4. The sound recording and playback unit 5 may use an IC memory for storing voice messages. The loudspeaker 4 may use a piezoelectric loudspeaker or the like operated by a power voltage of 1.3 V.

The swing-type switch 2 and the sound generator 40 are inserted, sealed, and thus housed in the front part of the tooth-brushing portion 1B and in the end part of the holding portion 1A, respectively, and these cannot be exchanged with each other when inserting into the toothbrush assembly 1.

The sound generator 40 has the sound recording and playback unit 5 for playing back different voice messages in accordance with different predetermined values reached by the sum of the pulses counted by the counter 3. More particularly, the sound generator 40 is configured so as to output different voice messages such as "not enough", "keep brushing", "a little more", and "brushed enough" through the loudspeaker 4 in accordance with different predetermined values such as 20, 50, 70, and 100, respectively, reached by the sum of the pulses counted by the counter 3.

The swing-type switch 2 has a stationary ring contact 2A fixed in the front part of the tooth-brushing portion 1B and the wire-spring swingable contact 2B inserted in the ring of the stationary ring contact 2A. The swingable contact 2B is fixed to the tooth-brushing portion 1B at one end thereof and has a weight 2C firmly fixed at the other end thereof so that the weight 2C can swing freely while the one end of the swingable contact 2B is fixed. Since the stationary contact 2A and the swingable contact 2B are both connected to corresponding input terminals of the counter 3, the swing-type switch 2 generates a pulse and sends it to the counter 3 when the wire-spring swingable contact 2B swings due to the inertia of the weight 2C in accordance with a tooth-brushing movement of a user and instantaneously contacts the stationary ring contact 2A.

Also, since a power supply controller 6 is disposed, for example, between the swing-type switch 2 and the counter 3, the power supply controller 6 makes the counter 3 operative when the power switch is instantaneously closed upon the first contact of the swingable contact 2B to the stationary contact 2A and also makes the counter 3 inoperative when the counter 3 does not receive a pulse for a predetermined time period.

The swing-type switch 2 of the toothbrush assembly 1 according to the first embodiment instantaneously closes the power switch for every swing of the swingable contact 2B in accordance with the tooth-brushing movement of a user and thus generates a pulse. Alternatively, a pulse generating circuit (not shown) independent from the swing-type switch 2 may be disposed between the swing-type switch 2 and the counter 3 so as to generate, for example, a constant pulse having a rectangular waveform for every swing of the swingable contact 2B of the swing-type switch 2 in accordance with the tooth-brushing movement.

Next, an example use and operation of the toothbrush assembly 1 according to the first embodiment will be described. In accordance with the tooth-brushing movement of a user after the toothbrush assembly 1 has toothpaste thereon, the wire-spring swingable contact 2B of the swing-type switch 2 swings due to the inertia of the weight 2C and generates a pulse upon instantaneously contacting the stationary ring contact 2A. The generated pulse is sent to the counter 3. When the power switch is closed upon the first contact of the swingable contact 2B to the stationary contact 2A, the power supply controller 6 makes the counter 3 operative so as to continue counting the pulses generated in the above-described manner.

When the sum of pulses sent to the counter 3 reaches one of predetermined values, the sound generator 40 generates a corresponding voice message. For example, the sound generator 40 outputs different voice messages such as "not enough", "keep brushing", "a little more", and "brushed enough" through the loudspeaker 4 in accordance with different predetermined values such as 20, 50, 70, and 100, respectively, reached by the sum of pulses sent to the counter 3. When the counter 3 does not receive a pulse for a predetermined time period, the power supply controller 6 makes the counter 3 inoperative so as to stop counting the pulses.

Since the toothbrush assembly 1 having the swing-type switch 2 according to the present invention has the above-described structure, it is more entertaining and interesting than conventional toothbrush assemblies and also encourages a young child to brush his or her teeth with its sound generating function.

More particularly, the toothbrush assembly 1 according to the present invention has the power switch, the swing-type switch 2 for generating a pulse when the power switch is instantaneously closed for every swing of the swingable contact 2B in accordance with the tooth-brushing movement of a user, the counter 3 for counting pulses sent from the swing-type switch 2, and the sound generator 40 for outputting a voice message through the loudspeaker 4 when the sum of the pulses counted by the counter 3 reaches a predetermined value. With this configuration, encouraging messages can be easily sent and heard by a young child who is brushing his or her teeth, thereby making the toothbrush assembly 1 more entertaining and interesting than the conventional toothbrush assemblies.

Since the sound generator 40 outputs different messages through the loudspeaker 4 in accordance with different predetermined values reached by the sum of the pulses counted by the counter 3, the encouraging messages can be easily sent in accordance with the number of tooth-brushing movements.

Since the swing-type switch 2 is housed in the front part of the toothbrush assembly 1 and the sound generator 40 is housed in the end part of the holding portion 1A, the swing-type switch 2, housed in the strongly shaken front part of the toothbrush assembly 1, can reliably generate pulses, and the sound generator 40 housed in the end part of the holding portion 1A which is not covered by a user's hand can reliably convey a voice message to a young child.

The swing-type switch 2 has the stationary ring contact 2A fixed in the front part of the toothbrush assembly 1 and the wire-spring swingable contact 2B which is swingably inserted in the ring of the stationary contact 2A and which has the weight 2C firmly fixed at the front thereof. Since the stationary contact 2A and the swingable contact 2B are both connected to the corresponding input terminals of the counter 3, the swing-type switch 2 generates a pulse and sends it to the counter 3 when the wire spring of the swingable contact 2B swings due to the inertia of the weight 2C in accordance with the tooth-brushing movement and instantaneously contacts the stationary ring contact 2A. With this configuration, the toothbrush assembly 1 with a sound generating function having an inexpensive and simple circuit configuration can be easily achieved.

Since the toothbrush assembly 1 has the power supply controller 6 for making the counter 3 operative when the power switch is closed upon the first contact of the swingable contact 2B to the stationary contact 2A and also for making the counter 3 inoperative when the counter 3 does not receive a pulse for a predetermined time period, the power consumption of an electric power source thereof can be reduced, and in addition, the circuit of the counter 3 can be automatically compensated.

Figure 3:
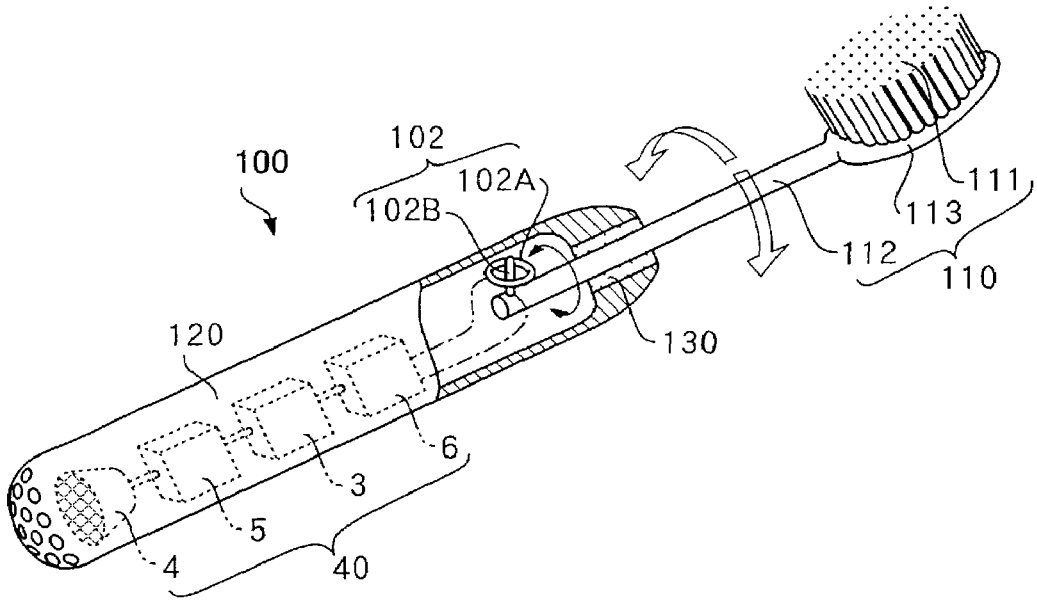
FIG. 3 is a schematic perspective view of a toothbrush assembly having a sound generating function and a contact-type switch according to a second embodiment of the present invention.
Figure 4:
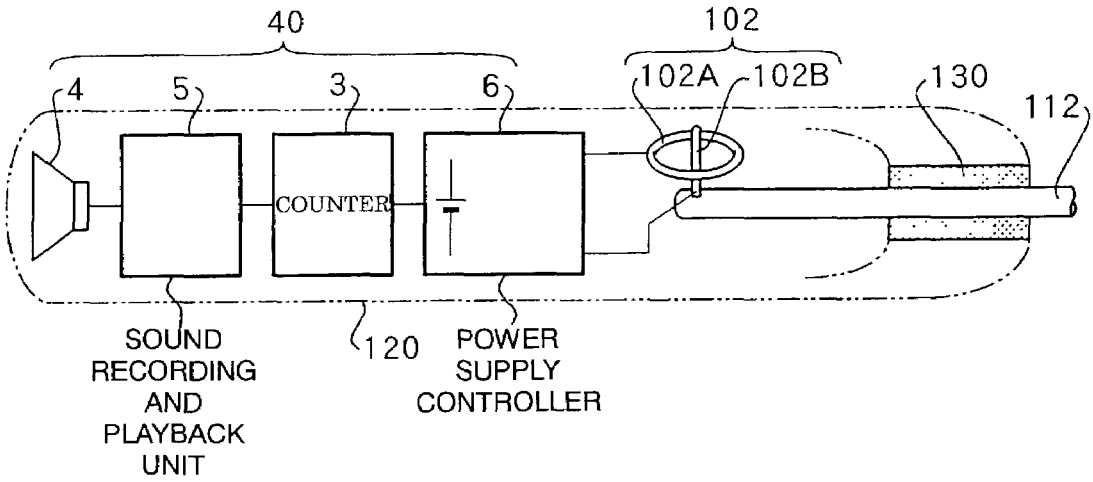
FIG. 4 illustrates a circuit configuration of the toothbrush assembly according to the second embodiment.

Referring now to FIGS. 3 and 4, another toothbrush assembly using a contact-type switch according to a second embodiment of the present invention will be described. A toothbrush assembly 100 according to the second embodiment has a hollow holding portion 120 and a tooth-brushing portion 110 having a handle 112. The hollow holding portion 120 has a contact-type switch 102, which causes the power switch to be instantaneously closed and which thus generates a pulse for every swing of a swingable contact 102B in accordance with the tooth-brushing movement of a user, and the sound generator 40 therein. The sound generator 40 includes the counter 3, using, e.g., a T-type flip-flop binary counting circuit, for counting pulses sent from the contact-type switch 102, the sound recording and playback unit 5, and the loudspeaker 4. The sound recording and playback unit 5 may use an IC memory storing voice messages. The basic configuration of the sound generator 40 is the same as that in the first embodiment described above.

The hollow holding portion 120 has the contact-type switch 102, an elastic waterproof tubular packing member 130, and the sound generator 40 at the end part thereof, all being housed therein. The handle 112 extending from the tooth-brushing portion 110 is swingably inserted into the holding portion 120 while being supported by the packing member 130.

The sound generator 40 has the sound recording and playback unit 5 for playing back different voice messages, musical tones, or the like in accordance with different predetermined values reached by the sum of the pulses counted by the counter 3.

More particularly, as shown in FIG. 3, the contact-type switch 102 is constructed such that the holding portion 120 has a stationary ring contact 102A fixed in the front part thereof parallel to the longitudinal direction thereof and the rod-like swingable contact 102B inserted into the ring of the stationary contact 102A. The swingable contact 102B is fixed at the end part of the handle 112 of the tooth-brushing portion 110 and protrudes from the end part in a direction orthogonal to the longitudinal direction of the tooth-brushing portion 110. Since the stationary contact 102A and the swingable contact 102B are both connected to corresponding input terminals of the counter 3, the contact-type switch 102 generates a pulse and sends it to the counter 3 when the swingable contact 102B swings together with the handle 112 in accordance with the tooth-brushing movement and instantaneously contacts the stationary ring contact 102A.

As shown in FIG. 4, the power supply controller 6 is disposed, for example, between the contact-type switch 102 and the counter 3. The power supply controller 6 makes the counter 3 operative when the power switch is instantaneously closed upon the first contact of the swingable contact 102B to the stationary contact 102A and also makes the controller inoperative when the counter 3 does not receive a pulse for a predetermined time period. To be specific, the toothbrush assembly 100 is configured such that the sound generator 40 outputs a voice message, a musical tone, or the like when the counter 3 repeatedly receives pulses for a predetermined time period, for example, at least 2 seconds.

The swing-type switch 102 of the toothbrush assembly 100 according to the second embodiment instantaneously closes the power switch for every swing of the swingable contact 102B in accordance with the tooth-brushing movement of a user and thus generates a pulse. Alternatively, a pulse generating circuit (not shown) independent from the contact-type switch 102 may be disposed between the contact-type switch 102 and the counter 3 so as to generate, for example, a constant pulse having a rectangular waveform for every swing of the swingable contact 102B in accordance with the tooth-brushing movement.

Next, an example use and operation of the toothbrush assembly 100 according to the second embodiment will be described. When the handle 112 elastically supported by the packing member 130 swings laterally relative to the longitudinal direction thereof in accordance with the tooth-brushing movement of a user after the tooth-brushing portion 110 has toothpaste thereon, the swingable contact 102B of the contact-type switch 102 instantaneously contacts the inner part of the ring of the stationary contact 102A. Intermittent pulses are generated upon the repeated contacts in the above described manner and are sent to the counter 3. When the power switch is closed upon the first contact of the swingable contact 102B to the stationary contact 102A, the power supply controller 6 makes the counter 3 operative so as to continue counting the pulses.

As described above, when the sum of pulses sent to counter 3 reaches one of the predetermined values, the sound generator 40 outputs a corresponding voice message or musical tone through the loudspeaker 4.

The toothbrush assembly 100 according to the present invention can be modified so as to make various modified operations thereof possible other than the operation described in the second embodiment. For example, the power supply controller 6 may have a timer for holding the electric power source for a time period of 10 seconds after the contact-type switch 102 of the toothbrush assembly 100 is activated. Upon the first activation of the contact-type switch 102, the sound generator 40 starts to play back music. When the contact-type switch 102 is activated again within the foregoing time period of 10 seconds, the timer holds the electric power source for another time period of 10 seconds starting from the second activation of the contact-type switch 102, and the music is continuously played back without a break. If the contact-type switch 102 is activated within the time period of 10 seconds after the last activation, the music is continuously played back, otherwise, the music stops.

Since the contact-type switch 102 is housed in the hollow holding portion 120 so that the handle 112 of the tooth-brushing portion 110 is swingably supported by the elastic waterproof packing member 130 and the sound generator 40 is housed in the end part of the holding portion 120, swings of the strongly shaken front part of the toothbrush assembly 100 can be easily converted into pulses, and the sound generator 40 housed in the end part of the holding portion 120 which is not covered by a user's hand can reliably convey voice messages, musical tones, or the like to a user.

The contact-type switch 102 has the swingable contact 102B protruding from the end of the handle 112 and the stationary ring contact 102A fixed in the front part of the holding portion 120 such that the swingable contact 102B is swingably inserted in the ring of the stationary contact 102A so as to contact the inner part of the ring when the handle 112 swings. Since the stationary contact 102A and the swingable contact 102B are both connected to the corresponding input terminals of the counter 3, the contact-type switch 102 generates a pulse and sends it to the counter 3 when the swingable contact 102B contacts the ring of the stationary contact 102A in accordance with the tooth-brushing movement. With this configuration, the toothbrush assembly 100 with a sound generating function having an inexpensive and simple circuit configuration can be easily achieved.

Since the toothbrush assembly 100 has the power supply controller 6 for making the counter 3 operative when the power switch is closed upon the first contact of the swingable contact 102B to the stationary contact 102A and also for making the counter 3 inoperative when the counter 3 does not receive a pulse for a predetermined time period, the power consumption of an electric power source thereof can be reduced.

Figure 5:
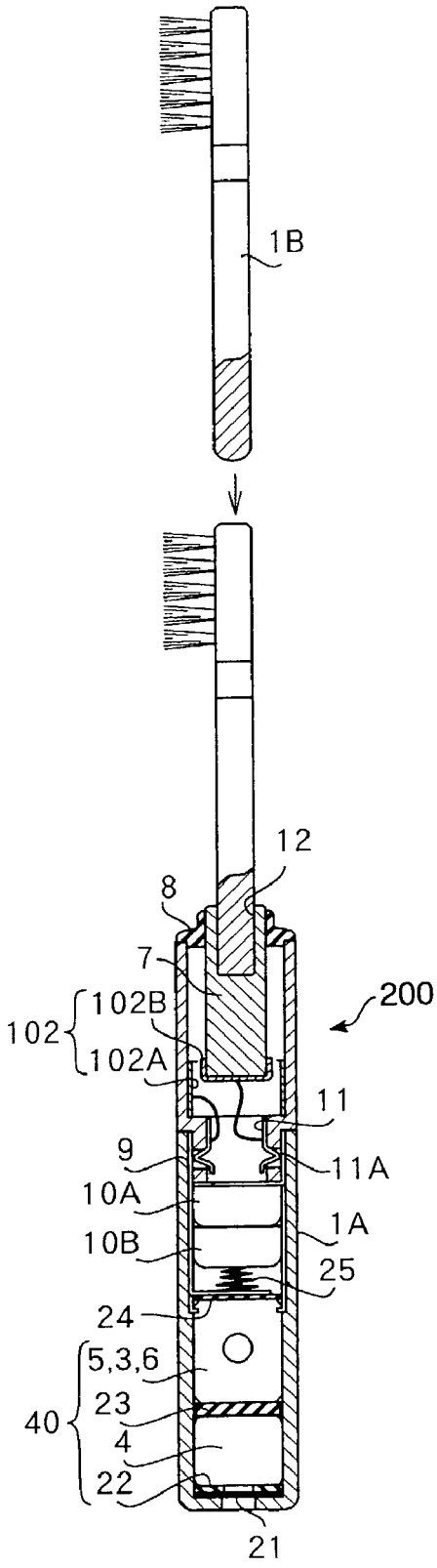
FIG. 5 is a partial sectional view of a toothbrush assembly having a sound generating function and an improved contact-type switch according to a third embodiment of the present invention.
Figure 6:
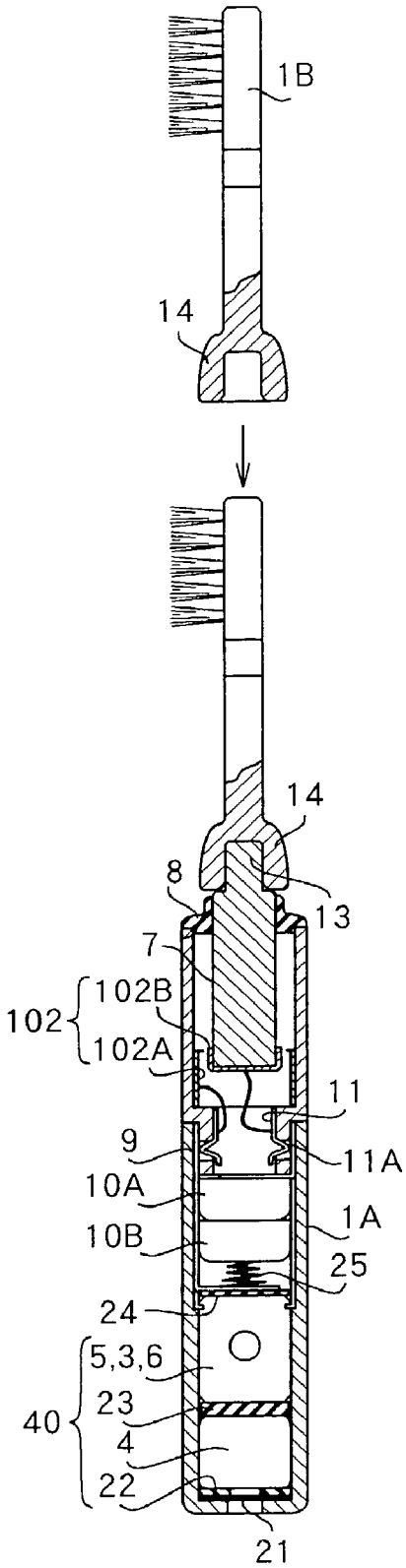
FIG. 6 is a partial sectional view illustrating a modification of the toothbrush assembly having a sound generating function and an improved contact-type switch according to the third embodiment of the present invention.
Figure 7:
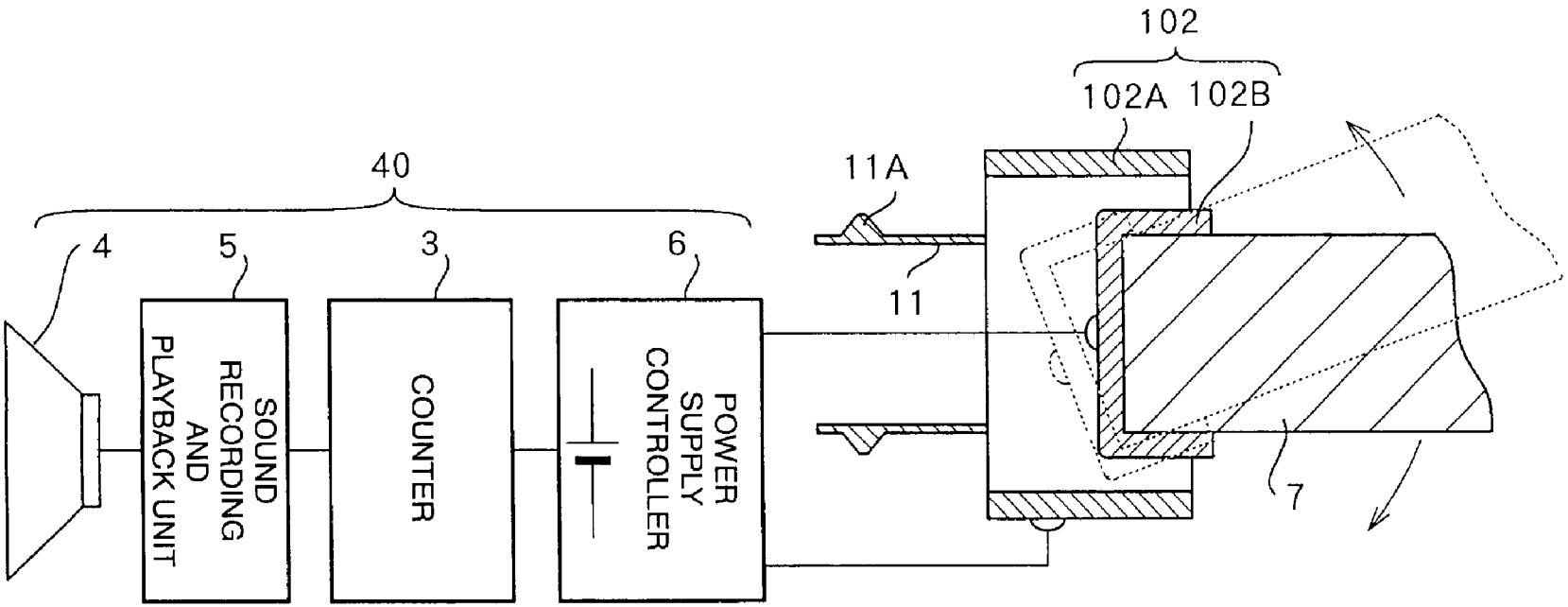
FIG. 7 is a schematic view illustrating a contacting operation of a swingable contact and a circuit configuration of the toothbrush assembly according to the third embodiment.

Referring now to FIGS. 5 to 7, another toothbrush assembly, having a contact-type switch which is an improvement of that in the foregoing second embodiment, according to a third embodiment of the present invention will be described. A toothbrush assembly 200 according to the third embodiment has a swingable tooth-brushing-portion support 7, which will be described later, for detachably supporting the handle of the tooth-brushing portion 1B. The contact-type switch 102, generating a pulse for every swing of the tooth-brushing-portion support 7 in accordance with the brushing movement of a user when the power switch is instantaneously closed corresponding to this swing, and the sound generator 40 are both housed in the holding portion 1A. The sound generator 40 includes the counter 3, using, e.g., a T-type flip-flop binary counting circuit, for counting pulses sent from the contact-type switch 102, the sound recording and playback unit 5 using, e.g., an IC memory for storing voice messages, and the loudspeaker 4 using a piezoelectric loudspeaker or the like operated by, e.g., two button-type batteries 10A and 10B, each having a power voltage of 1.3 V. The sound generator 40 operates so as to output or stop outputting a voice message, a musical tone, or the like when the sum of the pulses counted by the counter 3 reaches a predetermined value.

The contact-type switch 102 includes an elastic waterproof packing member 8, having a cap-shape, and the tooth-brushing-portion support 7 which has, for example, a round-bar shape and which has a fixing depression 12 at the top thereof for attaching the handle extending from the tooth-brushing portion 1B to the holding portion 1A. In the contact-type switch 102, the top of the tooth-brushing-portion support 7 is swingably fitted into and supported by the packing member 8 disposed in the open top of the cylindrical hollow holding portion 1A, and the end part of the tooth-brushing-portion support 7 is inserted into the hollow holding portion 1A without any restriction. The sound generator 40 is housed in the end part of the holding portion 1A. Also, the sound generator 40 and the contact-type switch 102 are sealed in the holding portion 1A, and these cannot be exchanged with each other when inserting into the holding portion 1A. In order to replace the two button-type batteries 10A and 10B with new ones, the holding portion 1A is formed from two detachable parts. Since the holding portion 1A has wiring grooves 9 formed about the central part thereof along the longitudinal direction thereof, these two parts are electrically connected with each other by wiring lines disposed in the wiring grooves 9 and at least one spring disposed to the contact-type switch 102. In the figures, the reference numeral 21 represents a film, the reference numerals 22 to 24 represent rubber plates, and the reference numeral 25 represents a spring. The vibration of the loudspeaker 4 is transferred to the outside via the film 21.

More particularly, as shown in FIG. 5, the contact-type switch 102 has a pair of spring legs 11 at the lower part thereof, each having an engaging protrusion 11A which protrudes outwardly so as to form an approximate V-shape, and is constructed such that the stationary ring contact 102A is fixed to a circular step, formed on the inner surface of the holding portion 1A, in a substantially coaxial manner with the holding portion 1A via the spring legs 11. The stationary ring contact 102A and the swingable contact 102B, which will be described later, are electrically connected to the pair of spring legs 11. A part of the swingable contact 102B attached to the tooth-brushing-portion support 7 into which the end of the handle of the tooth-brushing portion 1B is fitted is inserted into the ring of the stationary ring contact 102A. Since the stationary contact 102A and the swingable contact 102B are both connected to the input terminals of the counter 3, the contact-type switch 102 generates a pulse and sends it to the counter 3 when the swingable contact 102B attached to the tooth-brushing-portion support 7 swings together with the handle in accordance with the tooth-brushing movement and instantaneously contacts the stationary ring contact 102A.

The power supply controller 6 is disposed between the contact-type switch 102 and the counter 3. The power supply controller 6 makes the counter 3 operative when the power switch is instantaneously closed upon the first contact of the swingable contact 102B to the stationary contact 102A and also makes the controller inoperative when the counter 3 does not receive a pulse for a predetermined time period. To be specific, the toothbrush assembly 200 is configured such that the sound generator 40 outputs a voice message, a musical tone, or the like when the counter 3 repeatedly receives pulses for a predetermined time period, for example, at least 2 seconds.

FIG. 6 illustrates a modification of the toothbrush assembly 200 having the foregoing improved contact-type switch according to the third embodiment of the present invention. Like parts are identified by the same reference numerals in the above-described embodiments and their detailed description is omitted. In this modification, in place of the fixing depression 12 formed at the top of the tooth-brushing-portion support 7, a fixing projection 13 having a small diameter is formed at the top of the tooth-brushing-portion support 7 having, for example, a rod-like shape so as to attach the end of the handle extending from the tooth-brushing portion 1B to the tooth-brushing-portion support 7. Thus, the fixing projection 13 of the tooth-brushing-portion support 7 is detachably fitted into a semispherical fitting portion 14 which has a depression inside and which is formed at the end of the handle of the tooth brushing portion 1B.

The contact-type switch 102 of the toothbrush assembly 200 according to the third embodiment instantaneously closes the power switch for every swing of the swingable contact 102B in accordance with the tooth-brushing movement of a user and thus generates a pulse. Alternatively, a pulse generating circuit (not shown) independent from the contact-type switch 102 may be disposed between the contact-type switch 102 and the counter 3 so as to generate, for example, a constant pulse having a rectangular waveform for every swing of the swingable contact 102B in accordance with the tooth-brushing movement.

Next, an example use and operation of the toothbrush assembly 200 according to the third embodiment will be described. The handle of the tooth-brushing portion 1B is beforehand attached to the fixing depression 12 of the tooth-brushing-portion support 7. When the tooth-brushing-portion support 7 elastically supported by the packing member 8 swings laterally relative to the longitudinal direction thereof in accordance with the tooth-brushing movement of a user after the tooth-brushing portion 1B has toothpaste thereon, the swingable contact 102B of the contact-type switch 102 instantaneously contacts the inner part of the ring of the stationary contact 102A, as shown in FIG. 7. Intermittent pulses are generated upon the repeated contacts in the above described manner and are sent to the counter 3. When the power switch is closed upon the first contact of the swingable contact 102B to the stationary contact 102A, the power supply controller 6 makes the counter 3 operative so as to continue counting the pulses.

When the sum of pulses sent to the counter 3 reaches one of the predetermined values, the sound generator 40 outputs a corresponding voice message or musical tone through the loudspeaker 4. Since the way of outputting sounds such as voice messages or musical tones is the same as those in the above-described embodiments, its detailed description is omitted.

Various modifications of the toothbrush assemblies described in detail in the foregoing embodiments can be made within the scope of the present invention. In particular, the way of generating sounds is not limited to the one in which the voice messages are output according to the predetermined jobs as described above, and the way of generating sounds can be modified in various manners, for example, in a manner such that music is output from the beginning of tooth-brushing and stops if the tooth-brushing is continuously performed for a predetermined time period, and subsequently such that a sound for evaluating the tooth-brushing performance is output.

What is claimed is:

1. A toothbrush assembly with a sound generating function, comprising:

a sound generator;

a holding portion housing the sound generator;

an elastic member;

a tooth-brushing portion;

a tooth-brushing portion support which supports the end of the tooth-brushing portion, which is supported by the holding portion via the elastic member, and the end of which swings in the holding portion in accordance with the tooth-brushing movement of a user; and a contact-type switch comprising a stationary ring contact disposed in the holding portion; and a swingable contact disposed at the end of the tooth-brushing-portion support, wherein the sound generator controls the generation of different voice messages or musical tones in accordance with the movement of the contact-type switch.

2. The toothbrush assembly according to claim 1, wherein the holding portion comprises contacts and is dividable into two parts, one housing the contact-type switch, the other housing the sound generator, and wherein the contact-type switch and the sound generator are electrically connected via the contacts when the two parts are coupled with each other.

3. The toothbrush assembly according to claim 1, wherein the tooth-brushing portion is fitted into the tooth-brushing-portion support or fitted into and supported by the same.

* * * * *